United States Patent [19]

Troeh

[11] Patent Number: 4,483,024

[45] Date of Patent: Nov. 20, 1984

[54] VARIABLE FLUSH WATER CLOSET

[76] Inventor: Frederick R. Troeh, 4117 Quebec St., Ames, Iowa 50010

[21] Appl. No.: 412,124

[22] Filed: Aug. 27, 1982

[51] Int. Cl.[3] ..... E03D 1/14; E03D 3/12

[52] U.S. Cl. ..... 4/324; 4/325; 4/381; 4/391; 4/394; 4/382

[58] Field of Search ..... 4/324, 325, 331, 345, 4/355, 356, 378, 379, 381, 382, 384–386, 388, 391–395, 396, 397, 405, 411–415, DIG. 1, 249

[56] References Cited

U.S. PATENT DOCUMENTS

| | | | |
|---|---|---|---|
| 867,653 | 10/1907 | Gaylord | 4/381 |
| 1,262,710 | 4/1918 | Staats | 4/381 |
| 1,335,763 | 4/1920 | Stoltz | 4/381 |
| 1,377,712 | 5/1921 | Lewis | 4/381 |
| 2,001,390 | 5/1935 | Lester | 4/381 |
| 4,091,474 | 5/1978 | Makhobey | 4/324 |
| 4,232,408 | 11/1980 | Chen-Yuan | 4/325 |

FOREIGN PATENT DOCUMENTS

| | | | |
|---|---|---|---|
| 0010945 | 5/1980 | European Pat. Off. | 4/325 |
| 634759 | 3/1950 | United Kingdom | 4/381 |

*Primary Examiner*—Henry K. Artis

*Attorney, Agent, or Firm*—Zarley, McKee, Thomte, Voorhees & Sease

[57] ABSTRACT

An overflow pipe in a water closet supports a valve arm which carries a valve for opening and closing an outlet in the bottom of the tank. A first float is connected to the outer end of the valve arm to maintain the valve in an open position until the water level falls below a predetermined level. A second float is carried on a float arm pivoted intermediate its ends to the support. Cooperating lock means are provided on the end of the float arms opposite the float and in the travel path of the valve arm whereby a horizontally disposed pin on the valve arm is adapted to engage a horizontal surface on the adjacent end of the float arm and move therealong into locking engagement with a vertical shoulder thereby holding the valve in an open position until the water level in the tank falls below a second predetermined lower level thereby releasing the valve arm to return the valve to its closed position. A trip handle is connected to the first float for initially moving the valve to an open position.

2 Claims, 5 Drawing Figures

VARIABLE FLUSH WATER CLOSET

BACKGROUND OF THE INVENTION

Surveys have shown that the largest use of water in most households is for flushing toilets. Considerable interest has therefore centered on reducing the water used when toilets are flushed, especially at times and in places where there is a water deficiency and also where the amount of water to be processed by a septic system must be limited. Such conditions are common wherever private wells and septic systems are in use. They are not uncommon for community systems, and they sometimes become critical in times of drought.

Simple means of reducing flush volumes are often suggested and used by some persons. These include lowering the float valve or placing a brick or other solid object in the water closet. Sometimes these methods save water; other times they are self-defeating because the effectiveness of the flush is diminished and it may be necessary to flush twice for solid wastes instead of once.

Several prior art devices have been patented in an attempt to provide user control over the size of the flush so that a small flush may be used for liquid waste and a larger flush for solid waste. The advantage of such a system is obvious for saving water while retaining the effectiveness of the flush for sanitation purposes. Nevertheless, none of these devices has come into common use. Examination of the prior art patents reveals several reasons for their not being widely accepted. Many of them are complex devices and therefore expensive, subject to wear, and of questionable reliability. Most of them are difficult to install, requiring adjustments and/or periodic service beyond the ability of the average home owner. And, most of them require special techniques in use such as tripping the handle twice, or holding it for an extended time, or rotating it backwards for one mode of operation. None of them have provided the needed combination of being simple to install and use in existing as well as new equipment toilets and of being both durable and reliable. Representative devices are shown in patents as follows: U.S. Pat. Nos. 2,583,468, Jan. 22, 1952, Castellano; 2,962,727, Dec. 6, 1960, Kanter et al; 3,026,536, Mar. 27, 1962, Wood; 4,017,912, Apr. 19, 1977, Young; 4,135,263, Jan. 23, 1979, Anderson; 4,143,430, Mar. 13, 1979, Joshi.

SUMMARY OF THE INVENTION

The variable flush water closet of this invention is essentially a two-level flush system wherein the valve is operated by the same toilet trip lever as the usual single level types. The operational difference is that a light pressure on the toilet trip handle will cause the two-level flush valve to yield a small flush whereas a heavier pressure will cause a full flush. The user need understand no more than this light or heavy pressure effect to obtain the full benefit of saving water by this invention. A user who is completely unaware of the invention can use the toilet without difficulty because their normal operation of the trip lever will cause a flush to occur. The worst that might occur would be incomplete removal of solid waste necessitating a second flush.

DESCRIPTION OF THE PREFERRED EMBODIMENT

Figure 1:
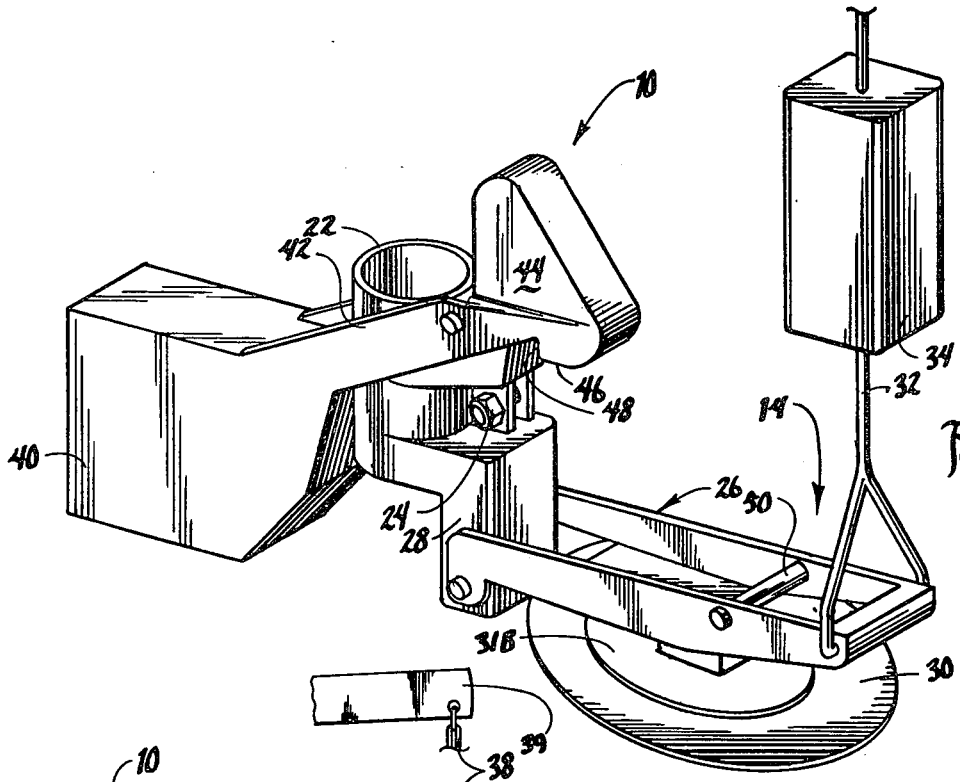
FIG. 1 is a perspective view of the water closet variable flush valve and float assembly.
Figure 2:
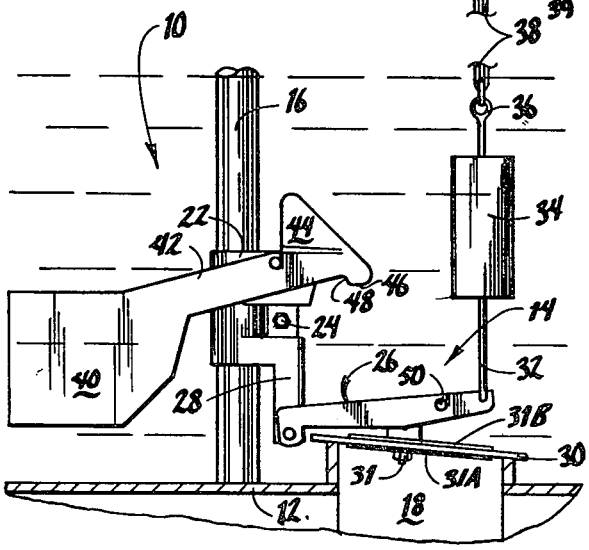
FIG. 2 is a side elevational view showing the valve in its closed position.

The variable flush water closet of this inventtion is referred to generally in FIG. 2 by the reference numeral 10 and includes a water closet tank 12 in which a valve and float assembly 14 is mounted on an overflow pipe 16 for opening and closing an outlet 18 in the bottom wall of the tank 12.

The valve and float assembly 14 includes a mounting sleeve 22 which may be locket tightly on the pipe 16 by operation of the bolt fastener 24. A valve arm 26 is pivotally carried on a downwardly extending support member 28 on the sleeve 22 and a valve element 30 is carried on the bottom side of the float arm for registering with the outlet 18. The valve element 30 is a flat disk member removably secured by the bolt 31 between a pair of metal plates 31A and 31B and matingly engages the upper open annular end edge of the outlet 18.

A float rod 32 is connected to the outer end of the float arm 26 and carries a float 34 which in turn is connected by an upper portion 36 of the rod 32 to a chain 38 in turn connected to a trip handle arm 39 actuatable from the outside of the tank 12 although not shown.

A second float 40 is carried on a float arm 42 which is pivotally connected to the support sleeve 22 and is positioned on the opposite side from the valve arm 26. The float arm 42 includes an arm portion 44 which extends above and in the vertical plane of the valve arm 26. The arm portion 44 includes a horizontal surface 46 and a vertical shoulder 48 which constitute cooperating lock means for engagement with a rod 50 on the float arm 26.

Figure 3:
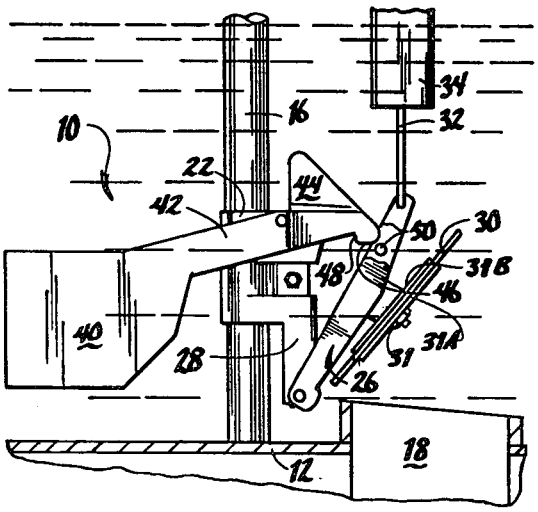
FIG. 3 is a view similar to FIG. 2 but showing the valve in its raised position for a small flush.

In operation it is seen in FIG. 2 that the valve 30 is in its closed position over the outlet 18 and in FIG. 3 the trip handle 39 has been actuated raising the valve arm 26 and the valve 30 to a position adjacent the float arm portion 44. The float 34 will hold the float arm in its raised position until the water level falls to a predetermined level rendering the float 34 inoperative to any longer hold the float arm in its raised position of FIG. 3. At this point the water pressure in the tank will force the valve 30 to its closed position of FIG. 2. This water pressure in the tank will be greater than the upward force of the float 34 when the valve 30 is in its closed position but once the valve is opened the float 34 will hold the valve in its open position until it is rendered inoperative by the water level falling to the predetermined water level. This operation thus provides for a small or partial flush.

Figure 4:
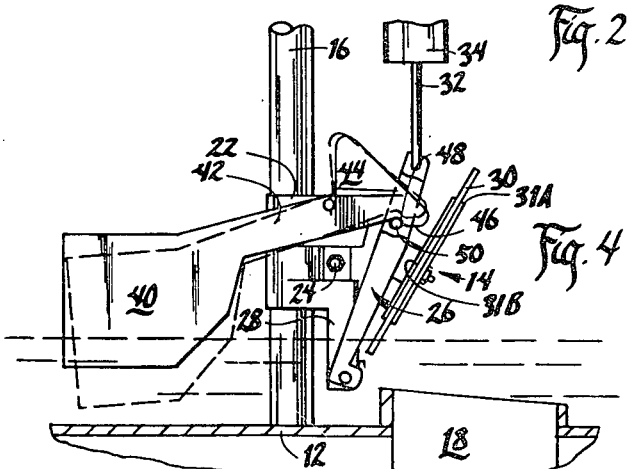
FIG. 4 is a view similar to FIG. 2 but showing the valve in its raised position for a full flush.
Figure 5:
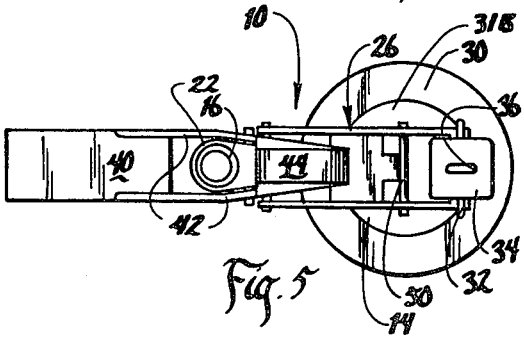
FIG. 5 is a top plan view thereof.

A full flush is made possible by actuating the trip handle sufficiently to cause the valve arm 26 to be raised to the position of FIG. 4 wherein the pin 50 moves against the horizontal surface 46 and therealong into engagement with the vertical shoulder 48. The float 40 is positioned lower in the water than the float 34 and thus remains operative after the float 34 is inoperative and thereby maintains a downward pressure on the pin 50 until the water level falls to a second predetermined level as seen in FIG. 4 which will then allow the float arm 42 to move downwardly raising the arm portion 44 and thereby disengaging the vertical shoulder 48 from the pin 50 which in turn allows the valve arm 26 and valve 30 to return to the closed position of FIG. 2. Without upward water pressure against the float 40 the balance is such that the float side of the arm 42 will pivot downwardly and the arm portion 44 will pivot upwardly.

Thus it is seen that two different quantities of water will be discharged through the outlet 18 depending on whether the second float 40 is actuated to hold the valve 30 in an open position longer than occurs when only the float 34 is made operative to hold the valve arm 26 and the valve 30 in their raised position.

It can be understood from the preceding explanation that the two-level flush valve can be operated to give either a small flush or a full flush at any time when the water closet is full. If desired, it can be flushed twice in rapid succession by using a light pressure first for the small flush. A heavier pressure will then flush the rest of the water from the water closet by means of the full-flush mode of operation even though the water closet may not have had time to refill.

Additional flush levels can be provided by means of a stepped connection being provided between the float 40 and the float arm 42 such that it would be adjustable vertically for different levels in the water and would be operative to hold the valve arm 26 in raised position for discharge of varying volumes of water. Alternatively, additional floats could be provided each having a locking means similar to the surface 46 and the shoulder 48 engageable with the pin 50 to provide the desired amount of water discharge before the valve arm 26 is finally released thereby allowing the valve element 30 to close the outlet 18.

The preceding explanation and the figures illustrate the preferred embodiment of the invention. It is readily understood that numerous variations of size, shape, and arrangement of parts could be made without changing the principles of operation. Such variations would clearly remain within the scope and spirit of the following claims. Furthermore, while the mechanism has been explained in terms of water closets for toilets, it may also be of use for controlling the discharge of fluids from containers in other applications.

I claim:

1. A variable flush water closet comprising, a water tank having a water inlet, and an outlet in the bottom of the tank, an outlet valve assembly in said tank including a valve positioned at said outlet to move between a raised open and a lowered closed position, valve actuating means connected to said valve for moving said valve to said raised open position, first and second float means in said tank vertically spaced apart and operatively connected to said valve to yieldably hold said valve in said raised open position after said valve has been moved to said raised open position by said actuating means, said first float means being higher than said second float means and upon said water falling to a predetermined level said first float is no longer biased upwardly by said water thereupon allowing said valve to move downwardly to close, said first float and said valve actuating means being interconnected at its upper end to an actuating lever and at its lower end including a flexible element connected to said first float and said first float being connected by a rod means to said valve, said float when in its raised open position and when operating independently of said second float is held in said raised position only by the upward bias of the water upon said first float, and said valve actuating means including means for selectively operatively engaging said valve with said second float positioned lower in said tank than said first float means and upon said water falling to a predetermined second level below said first level said second float moves downwardly operatively being disengaged from said valve allowing said valve to close whereby when said second float means is connected to said valve a larger quantity of water in said tank is discharged through said outlet than when only said first float means is connected to said valve, said second float means and said valve including cooperating locking means positioned to be engaged upon said valve element being raised a predetermined amount by said actuating means and disengaged upon said water falling to said second predetermined level rendering said second float inoperative, said second float including a pivot arm pivotally supported intermediate its ends on an overflow pipe support adjacent said outlet and having said cooperating means on the end thereof opposite said float and in the path of the cooperating means on said valve whereby when said valve is raised a predetermined distance said cooperating means on said second float and said valve are engaged and when said water falls to said second predetermined level said cooperating means on said second float moves upwardly as said second float moves downwardly and said cooperating means on said second float and said valve are disengaged allowing said valve to move to said lowered closed position, said second float being on the opposite end of said pivot arm with said second float and said cooperating means being positioned on opposite sides of said pipe support, said cooperating means being further defined as to said second float means as being a downwardly facing horizontal surface which merges into a vertical shoulder surface and said cooperating means on said valve including a horizontally disposed pin positioned to engage said horizontal surface as said valve is pivoted upwardly and move therealong into locking engagement with said vertical shoulder and upon said second float means pivoting downwardly said vertical shoulder is pivoted upwardly and out of locking engagement with said pin.

2. The device of claim 1 wherein said second float and said valve are each pivotally secured to said pipe support by a sleeve clamp which is variably adjustably securable along said pipe support.

* * * * *